United States Patent [19]

Bernatt

[11] 4,063,208

[45] Dec. 13, 1977

[54] FUSE HOUSING END CAPS SECURED BY MAGNETIC PULSE FORMING

[75] Inventor: Joseph Bernatt, Arlington Heights, Ill.

[73] Assignee: S & C Electric Company, Chicago, Ill.

[21] Appl. No.: 633,488

[22] Filed: Nov. 19, 1975

[51] Int. Cl.[2] ..... H01H 85/14

[52] U.S. Cl. ..... 337/248; 72/56; 337/186

[58] Field of Search ..... 337/158, 159, 186, 231, 337/248; 72/56; 29/421 M, 623

[56] References Cited

U.S. PATENT DOCUMENTS

| | | | |
|---|---|---|---|
| 3,250,879 | 5/1966 | Jacobs | 337/248 |
| 3,313,536 | 4/1967 | Dutton et al. | 29/421 M X |
| 3,333,336 | 8/1967 | Cameron et al. | 29/623 |
| 3,438,115 | 4/1969 | Humphress et al. | 29/421 M |
| 3,529,270 | 9/1970 | Kozacka | 337/248 X |
| 3,848,325 | 11/1974 | Bimba | 29/421 M X |
| 3,967,228 | 6/1976 | Koch et al. | 337/248 |

*Primary Examiner*—George Harris

*Attorney, Agent, or Firm*—Kirkland & Ellis

[57] ABSTRACT

End ferrules of a current limiting fuse are mounted to the end of a relatively fragile non-metallic insulator housing of the fuse by magnetic pulse forming. The end ferrules are formed so that there is a flat circular end wall and an annular mounting flange. The flat circular end walls are of a first thickness sufficient to withstand mechanical forces that may be experienced due to fuse operation or due to mounting of the fuse. The annular mounting flange is of a second thickness less than the first thickness so that the flange can be compressed around the housing by magnetic pulse forming without causing undue stress to be exerted on the housing that may result in damage to the housing. A unique elastomer ring seal is provided between the housing and the end ferrule to assure a moisture tight seal. The method disclosed is applicable to allow compressive attachment of a variety of metallic members to a variety of relatively fragile members so that the strength of the metallic member may be maintained, but the metallic member may be compressed without damage to the fragile member.

13 Claims, 7 Drawing Figures

10
12
14
16
18
20
22
24
26
28
30
3
3

FUSE HOUSING END CAPS SECURED BY MAGNETIC PULSE FORMING

BACKGROUND OF THE INVENTION

1. Field of the Invention

The present invention relates to composite articles of manufacture comprising metallic members attached to a relatively fragile non-metallic member by magnetic pulse forming and methods of fabrication thereof, and more particularly, the present invention relates to high voltage fuse construction involving the attachment of a metal ferrule to a relatively fragile cylindrical housing by magnetic pulse forming and methods of fabricating thereof.

2. Description of the Prior Art

Magnetic pulse forming machines were first introduced in 1962. Since that time, magnetic pulse forming machines have been utilized to assemble a variety of composite articles of manufacture which would be difficult and costly to assemble by conventional methods.

Magnetic pulse forming is an assembly technique which utilizes a high intensity magnetic field to expand or contract metallic work pieces. Magnetic pulse forming is based on the interaction of a rapidly changing magnetic field and the currents induced in an electrically conductive work piece. Magnetic pulse forming is capable of compressing or expanding metal members without direct physical contact and without lubricants or torque normally encountered in rolling and spinning operations.

The high flux densities necessary to perform such magnetic pulse forming can be produced in the absence of a material of high permeability by discharging a capacitor through a coil for a period of a few microseconds. Thus, tremendous flux densities are produced for a short period of time. Further, since it is the magnetic force which moves the metal, the introduction of a non-cnductive material between the work piece and the magnetic field producing member has no effect on the assembly operation, although more energy is required for this type of operation because of the increased distance through which the magnetic field must act.

Magnetic pulse forming is particularly advantageous to form metallic members to non-metallic members. For example, brass tubing and aluminum sleeves may be successfully assembled to Bakelite and/or phenolic materials to provide structurally sound joints. The time consuming and costly spinning operations generally required for such assemblies are eliminated when the parts are assembled magnetically.

However, some difficulty is experienced when assembling metallic members to non-metallic relatively fragile members. For example, many non-metallic materials have a relatively high tensile strength but a relatively low compressive strength. Consequently, extreme care must be utilized when compressing such metallic members onto such non-metallic members by magnetic pulse forming to prevent fracture of the non-metallic member. A further problem is experienced where the metallic members must be of sufficient strength to withstand stress forces applied to the metallic member but the member must be compressed onto a relatively fragile non-metallic member. Since the metallic member must be thick enough to withstand the stress applied, a relatively large magnetic force must be applied to compress the metallic member onto the non-metallic member by magnetic pulse forming. Often in such circumstances, magnetic pulse forming is not suitable since sufficient force cannot be applied to compress the metallic member without also fracturing the non-metallic member.

Accordingly, it would be a desirable advance in the art to provide a composite article of manufacture including a relatively fragile non-metallic member upon which is attached a metallic member by magnetic pulse forming and methods of fabrication thereof which avoid the above mentioned problems.

BRIEF DESCRIPTION OF THE INVENTION

A composite article of manufacture in accordance with the present invention comprises a first member formed of a brittle material or a material having low compressive strength and a second metallic member that is normally anticipated to be subjected to mechanical stress. The second metallic member includes a first portion dimensioned to withstand the anticipated mechanical stress, and a second portion integrally connected to the first portion and being dimensioned to be compressed onto the first member to attach the second member to the first member by magnetic pulse forming without damaging the first member.

More specifically, the first member may be a cylindrical hollow housing of an electrical fuse which is formed of an electrically insulating material having low compressive strength. The second metallic member may comprise an end member having a circular end wall of a first thickness sufficient to withstand the mechanical stress incident to the mounting and operation of the fuse. An annular flange is formed integrally with the circular end wall along the edge thereof and extending approximately perpendicular thereto. The flange has a second thickness less than the first thickness of the circular end wall. First and second end members are positioned over opposite open ends of the housing and the annular flanges are compressed onto the ends of the housing by magnetic pulse forming. The second thickness of the flange of the end walls is thin enough to permit the annular flanges to be compressed by magnetic pulse forming without causing damage to the housing.

The housing may also include an annular two-sided groove formed around the exterior edge of each end of the housing which is dimensioned to receive a seal member, such as an elastomer ring so that when the first and second members are attached over the ends of the housing, the seal members seat against the end members providing a moisture-proof seal between the end members and the housing. To further assure a proper seal, the seal members may be coated with a vulcanizing silicone rubber material.

The present invention also involves a method of attaching a metallic member that will be subject to stress to a relatively fragile non-metallic member by compressing a portion of the metallic member around the fragile member. The method comprises the steps of forming the metallic member so that the portion of the metallic member that is subject to the stress is of a first thickness sufficient to withstand those stresses and the portion of the metallic member that will be compressed onto the fragile member is of a second thickness thin enough to permit compression without damaging the fragile member. The next step is to place the metallic member in the proper position over the fragile member, and the last step is to compress the portion having the second thickness against the fragile member by magnetic pulse forming.

Accordingly, it is a primary object of the present invention to provide a composite article of manufacture and method of fabrication thereof for attaching a metallic member to a relatively fragile non-metallic member by magnetic pulse forming without damaging the relatively fragile member.

It is yet another object of the present invention to provide a unique construction of a high voltage fuse having metallic end members attached to a non-metallic insulator housing by magnetic pulse forming in such a manner that damage to the insulator housing is avoided.

It is another object of the present invention to provide a unique construction for a high voltage fuse having a unique seal between the insulated housing and end member that assures a moisture-proof seal.

It is yet another object of the present invention to provide a method of connecting a metallic member to a non-metallic member having relatively low compressive strength by magnetic pulse forming in such a manner that damage to the non-metallic member is avoided.

These and other objects, advantages, and features will hereinafter appear, and for the purpose of illustration, but not of limitation, exemplary embodiments are illustrated in the accompanying drawings.

DETAILED DESCRIPTION OF PREFERRED EMBODIMENTS

Figures 1, 2, 3, 4:
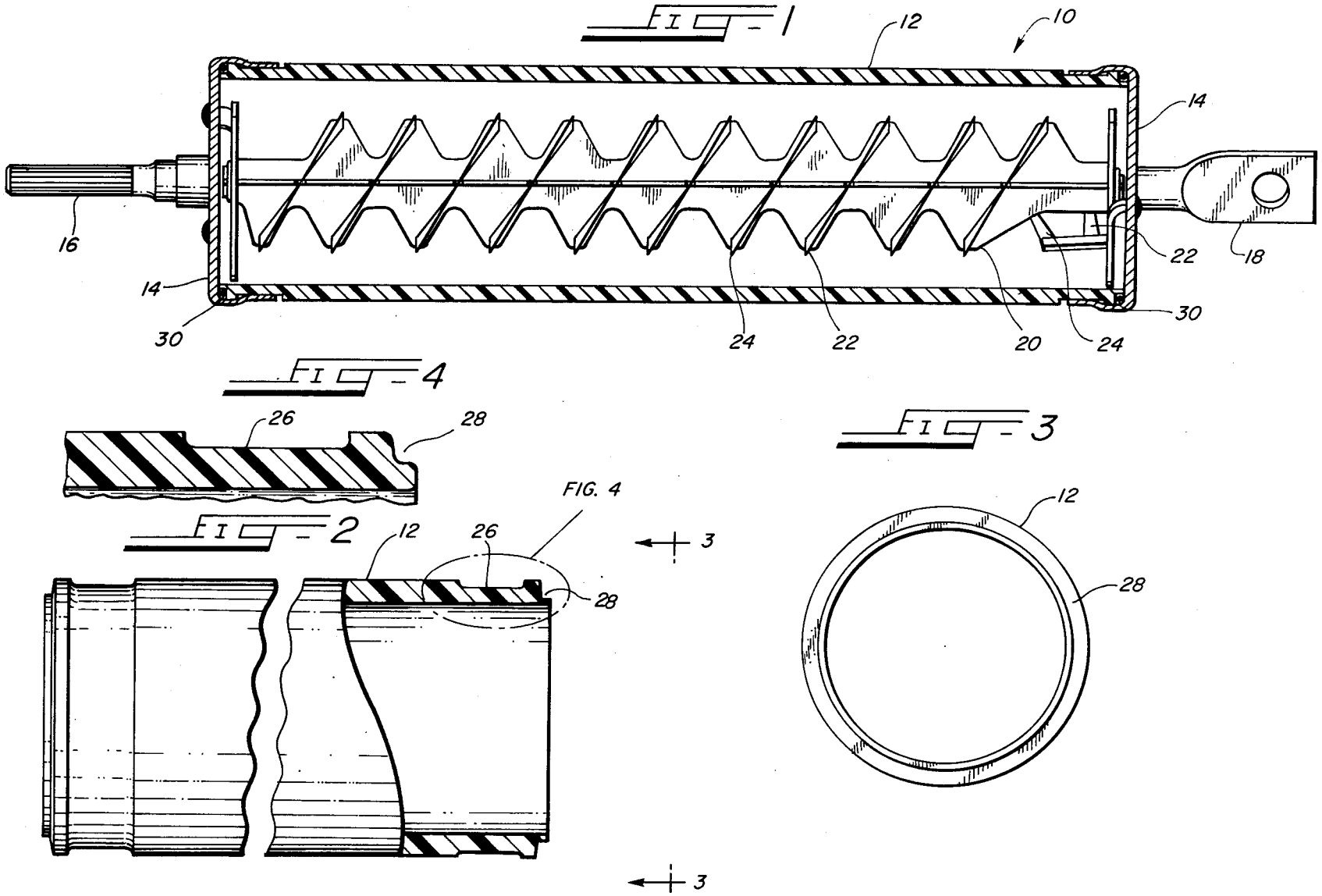
FIG. 1 is a cross-sectional view of a high voltage fuse preferred embodiment of the present invention.
FIG. 2 is a partially fragmentary, partially cross-sectional view of the insulator housing of the preferred embodiment illustrated in FIG. 1.
FIG. 3 is an end view taken substantially along line 3—3 in FIG. 2.
FIG. 4 is a cross-sectional, partially fragmentary view of a portion of the end of the insulator housing.

With reference to FIG. 1, high voltage fuse 10 comprises hollow cylindrical insulator housing 12 of a suitable electrically insulating material such as glass reinforced epoxy resin. Mounted over each end of hollow cylindrical housing 12 in a manner more fully described hereinafter are metallic end ferrule members 14. mounted on end ferrule members 14 are a mounting stud 16 and a mounting spade 18 for connecting the fuse 10 in a high voltage electrical circuit. Mounted on the inside of housing 12 is fusible element support assembly 20 which supports fusible elements 22 and 24. The exact construction of fusible element support assembly 20 does not form a part of the subject matter of the present invention and is more fully described in co-pending patent application Ser. No. 633,487, filed Nov. 19, 1975, assigned to the same assignee as the present invention. With reference to FIGS. 2, 3, and 4, housing 12 contains an annular groove 26 formed around the exterior of housing 12 adjacent each end thereof. Also formed around the exterior edge of each end of housing 12 is a two-sided groove 28 in which an elastomer ring 30 is positioned. Groove 28 is dimensioned so that elastomer ring 30 extends slightly beyond the end of housing 12 so that when end ferrule member 14 is positioned over the end of housing 12 and connected thereto a moisture-proof seal is formed between housing 12 and ferrule member 14 due to compression of the ring 30 by the ferrule 14. Such compression may be in one or both of two primary directions, namely parallel to the major axis of the housing 12 or perpendicular thereto.

Figure 6:
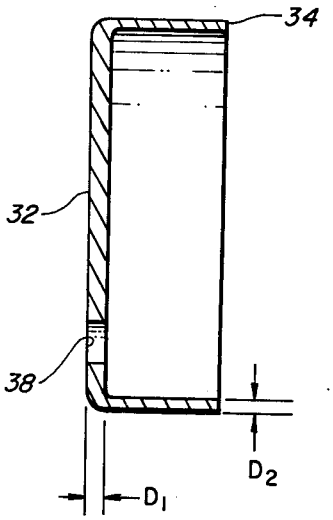
FIG. 6 is a cross-sectional view taken substantially along line 6—6 in FIG. 5.
Figure 5:
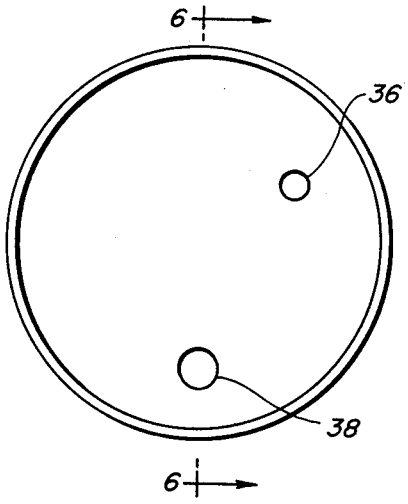
FIG. 5 is an end view of the end ferrule member of the preferred embodiment illustrated in FIG. 1.

With reference to FIGS. 5 and 6, end ferrule members 14 are initially fabricated to comprise an essentially flat circular end wall 32 and an annular flange 34 integrally formed to the flat circular end wall around the periphery thereof and extending approximately perpendicular from flat circular end wall 32. An opening 36 is provided through end wall 32 for receiving the end of support assembly 20 so that support assembly 20 may be welded to end ferrule members 14. In addition, another opening 38 may be provided through end ferrule member 14 to allow an electrically non-conducting filler material such as quartz sand to be inserted into fuse 10 after end ferrule members 14 have been mounted to the ends of housing 12. Opening 38 is then welded closed after the filler material has been inserted. A suitable mounting fixture such as mounting stud 16 or mounting spade 18 may be welded to the center of circular end wall 32 as illustrated in FIG. 1.

When fuse 10 is mounted in an electrical circuit, mechanical forces may be exerted on end wall 32 by mounting stud 16 and mounting spade 18 due to the mass of the fuse 10 supported thereby. Further, when fuse 10 operates, fusible member 22 and 24 will rapidly vaporize causing an increase in gas pressure within the fuse 10. Accordingly, end ferrule member 14 will experience stresses incident to both the mounting and operation of fuse 10. To withstand these stresses, end wall 32 is fabricated so that it has a thickness D1 (see FIG. 6) that is thick enough to withstand the stresses that will be applied to end wall 32. However, since housing 12 is typically formed of a glass reinforced epoxy resin material which has a relatively high tensile strength but a relatively low compressive strength, hollow cylindrical housing 12 is relatively fragile and could be damaged when end ferrule members 14 are compressed over the ends of housing 12. Accordingly, annular flange 34 is fabricated to have a thickness D2 which is less than the thickness D1 of circular end wall 32. Thickness D2 is selected so that flange 34 can be compressed by magnetic pulse forming without causing damage to housing 12.

Figure 7:
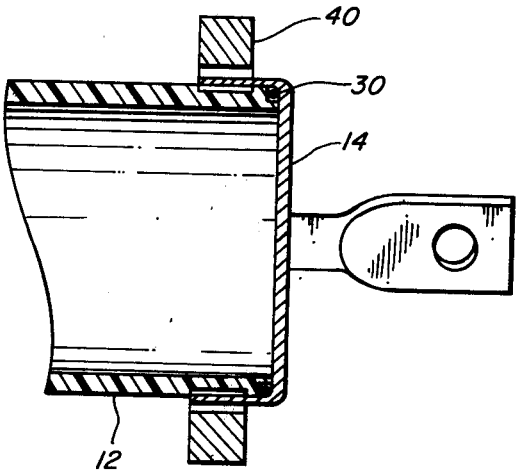
FIG. 7 is a cross-sectional, partially fragmentary view showing the end ferrule member in position ready for magnetic pulse forming.

End ferrule members 14 are attached to the end of housing 12 by magnetic pulse forming. With reference to FIG. 7, an uncompressed end ferrule member 14 is shown positioned over the end of housing 12 with the magnetic pulse forming flux producing member 40 positioned immediately adjacent annular flange 34. Flux producing member 40 is a part of conventional magnetic pulse forming equipment that operates in the conventional manner to produce a short duration, high flux magnetic field which causes a compressive force to be applied to annular flange 34 to cause annular flange 34 to be compressed into annular groove 26 as illustrated in FIG. 1.

Elastomer ring 30 is placed in groove 28 before end ferrule member 14 is placed over the end of housing 12. Elastomer ring 30 forms a seal between the housing 12 and the end ferrule member 14. To further facilitate the seal between the housing 12 and end ferrule member 14, the elastomer ring 30 may be coated with a vulcanizing silicone rubber material such as the vulcanizing silicone rubber material sold under the trademark SILASTIC, 732 RTV by the Dow Corning Co. This one-part vulcanizing silicone rubber acts to further assure that a moisture-proof seal is formed between housing 12 and end ferrule member 14. This is particularly desirable where housing 12 is fabricated from a glass reinforced epoxy resin since it is difficult to machine a smooth groove 28 in such material that will provide a moisture-proof seal with elastomer ring 30. The vulcanizing silicone rubber material assures a moisture-proof seal despite possible roughness of groove 28.

Since housing 12 is not capable of withstanding substantial compressive stresses, the thickness D2 of annular flange 34 must be sufficiently thin so that it may be magnetically pulse formed around housing 12 without causing housing 12 to crack or be otherwise damaged. However, since flat circular end wall 32 is not subject to magnetic pulse forming but is subjected to substantial mechanical stresses during mounting and fuse operation, the thickness D1 of circular end wall 32 may be made much thicker to withstand the mechanical stresses without jeopardizing the ability of the end ferrule member 14 to be magnetically pulse formed over the end of housing 12.

It should be apparent that the method and technique of attaching metallic end ferrule member 14 to the end of relatively fragile cylindrical housing 12 has applicability in a wide range of composite articles of manufacture wherein a metallic member must be attached to a relatively fragile non-metallic member by magnetic pulse forming. Thus, where a portion of the metallic member will experience mechanical stresses, that portion may be made substantially thick enough to withstand those mechanical forces provided that the portion of the metallic member which is compressed over the relatively fragile non-metallic member is made thin enough so that when the metallic member is compressed over the fragile member by magnetic pulse forming damage does not result to the fragile member.

Thus, it may be seen that a variety of metallic members may be mounted to a variety of relatively fragile non-metallic members by magnetic pulse forming utilizing the invention described herein without departing from the spirit and scope of the present invention as defined in the appended claims.

I claim:

1. An electrical fuse comprising:

a cylindrical hollow housing formed of a non-metallic, low compressive stress resistant, electrically insulating material, said housing having opposite open ends and an annular recess formed adjacent each end on the exterior of said housing;

first and second end members each comprising:

a circular end wall having a first thickness sufficient to withstand mechanical stress incident to mounting and operation of said fuse;

an annular flange formed integrally with said circular end wall along the edge thereof and extending approximately perpendicular thereto, said flange having a second thickness less than the first thickness:

said first and second end members positioned over the opposite open ends of said housing, the annular flanges being compressed into the annular recesses formed in said housing by magnetic pulse forming to attach and seal said first and second end members over the open ends of said housing;

said second thickness being thin enough to permit said annular flanges to be compressed by magnetic pulse forming without causing damage to said housing;

a current responsive element connected between said first and second end members.

2. A high voltage fuse, as claimed in claim 1, wherein said housing has an annular two-sided groove formed around the exterior edge of each end of said housing dimensioned to receive an elastomer ring therein so that when said first and second members are attached over the ends of said housing, said elastomer ring seat against said end members providing a moisture-proof seal between said end members and said housing.

3. A high voltage fuse, as claimed in claim 2, wherein said elastomer ring is coated with a vulcanizing silicone rubber material.

4. A high voltage fuse, as claimed in claim 1, wherein said first end member has an opening therethrough for permitting insertion of an electrically non-conductive filler material into said fuse after said first and second end members are attached.

5. A high voltage fuse, as claimed in claim 1, wherein said first thickness is approximately twice the second thickness.

6. A high voltage fuse, as claimed in claim 1, wherein said first and second end members have mounting fixtures attached thereto.

7. An improved fuse of the type which includes a fusible element supported within an open-ended insulative housing, the housing having high tensile strength but low compressive strength, wherein the improvement comprises:

a metallic ferrule for closing an open end of the housing, the ferrule including an end wall by which the fuse is mounted and which is shaped complementarily to the cross-section of the housing, and a flange which is thinner than the end wall and which is formed integrally with, and generally perpendicular to, the end wall, the flange being compressed by magnetic pulse forming against the periphery of the housing to maintain the end wall against the open end thereof;

the relative thicknesses of the end wall and the flange being selected so that the end wall is capable of withstanding forces due to fuse mounting and fuse operation, and the flange is compressible against the housing without applying harmful compressive forces thereto.

8. The fuse of claim 7 which further includes:

a groove formed in the exterior of the housing adjacent to, but spaced from, an end of the housing, a portion of the compressed flange being compressed into the groove.

9. The fuse of claim 8 wherein the groove is continuous about substantially the entire periphery of the housing.

10. The fuse of claim 9 wherein the housing is generally cylindrical.

11. The fuse of claim 7 which further includes:

a two-sided groove formed in an exterior edge at an end of the housing; and an elastomer member in the two-sided groove which is compressed by the ferrule to provide a seal between the ferrule and the housing.

12. The fuse of claim 11 wherein the two-sided groove is continuous about substantially the entire periphery of the housing end.

13. The fuse of claim 12 wherein the housing is generally cylindrical.

* * * * *

UNITED STATES PATENT AND TRADEMARK OFFICE

CERTIFICATE OF CORRECTION

PATENT NO. : 4,063,208

DATED : December 13, 1977

INVENTOR(S) : Joseph Bernatt

It is certified that error appears in the above-identified patent and that said Letters Patent are hereby corrected as shown below:

Column 1, line 39, "non-cnductive" should read "non-conductive".

Column 3, line 52, "mounted" should read "Mounted".

Column 6, line 10, "seat" should read "seats".

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*